United States Patent [19]

Hawes

[11] 3,993,001

[45] Nov. 23, 1976

[54] EXPLOSIVE EXPANSION MEANS FOR ATTACHING TUBES TO TUBE SHEETS

[75] Inventor: Frederick L. Hawes, Ladue, Mo.

[73] Assignee: Tetra Plastics, Inc., Chesterfield, Mo.

[22] Filed: Aug. 18, 1975

[21] Appl. No.: 605,457

[52] U.S. Cl. ..... 102/24 R; 102/27 R; 228/2.5

[51] Int. Cl.² ..... F42B 3/00

[58] Field of Search ..... 102/22–24, 102/27; 72/56; 29/421 E; 228/2.5, 107, 108, 109

[56] References Cited

UNITED STATES PATENTS

| | | | |
|---|---|---|---|
| 2,912,148 | 10/1975 | Johnson | 228/2.5 |
| 2,952,206 | 9/1960 | Beckstead | 102/27 R |
| 3,205,818 | 9/1965 | Coulson | 102/27 R |
| 3,311,056 | 3/1967 | Noddin | 102/27 R |
| 3,342,133 | 9/1967 | Strom et al. | 102/27 R |
| 3,349,706 | 9/1967 | Schaumann | 102/27 R |
| 3,426,681 | 2/1969 | Oliver | 102/24 R |
| 3,562,887 | 2/1971 | Schroeder et al. | 29/421 E |

*Primary Examiner*—Verlin R. Pendegrass
*Attorney, Agent, or Firm*—Charles B. Haverstock

[57] ABSTRACT

A plastic tube and tube end cap for installation in a metal tube or the like when the metal tube is positioned extending through a passage in a tube sheet, such that the plastic tube and end cap cooperate to accurately position an explosive charge which, when detonated, causes the plastic tube to expand outwardly against the metallic tube with such force that the metal tube makes intimate contact with the respective passage through which it extends in the tube sheet, without contaminating or damaging the metal tube in the process. The subject plastic tube and tube end cap have portions which cooperate to hold them together and further cooperate so that when the plastic tube is inserted into the metal tube the explosive charge will be accurately positioned. The end cap may optionally have openings therethrough which are located to relieve the expansion forces at a selected location produced during an explosion, and the end cap has a portion which can be deformed to permit positioning an explosive cord therein but which prevents movement of the cord when the deforming forces are relieved.

21 Claims, 13 Drawing Figures

20
12
22
52
49
47
24
48
26
28
16
32
34
30
36
38

52
47
28
16
40
30

44
42
46
18
56
28
37
50
30
36
38

EXPLOSIVE EXPANSION MEANS FOR ATTACHING TUBES TO TUBE SHEETS

The need to provide means for accurately and precisely explosively expanding a tubular member such as a metallic tubular member into intimate physical engagement with a member through which it extends has long been recognized and various devices and means have been developed and used for this purpose. The known devices and means, however, have been unsatisfactory in some respects, including the following: they lack means to quickly and accurately position and hold the explosive means; they do not provide means for adequately relieving the explosive forces produced at some but not at other locations in order to prevent damage to the parts; and the known devices are relatively time consuming to assemble and install. Most known devices used for this purpose have also undesirably contaminated the members being expanded. These and other disadvantages and shortcomings of the known devices are overcome by the present construction. Examples of typical known devices which have these and other disadvantages and shortcomings are disclosed in U.S. Pat. Nos. 3,205,818; 3,342,133; 3,411,198; 3,426,681 and 3,543,370 which are the closest known prior art constructions.

The present invention is directed to the use of relatively resilient but difficult to rupture plastic expansion tubes, such as polyethylene tubes, which are closed at one end and which act as pressure cartridges in the explosive expansion of metallic tubes that are positioned extending through openings in tube sheets. Each of the subject expansion tubes has means adjacent to one end for receiving and cooperating with an end cap which is attached thereto, and which may be constructed to have pressure relief openings so that explosive forces generated adjacent to the cap when the plastic tube explosively expands can relatively easily escape near the capped tube end without substantially expanding the plastic tube thereat. The end cap construction used in the present devices includes a deformable portion through which an explosive charge or cord can easily be moved, when deformed. Thereafter when the tube portion is no longer deformed it will assume an unstressed condition in which it grips and holds the cord and prevents further movement of the cord therein. This feature is important as means to quickly and accurately locate the explosive cord in the end cap and in the respective expansion tube so as to control the position of the cord in the expansion tube when the end cap is installed thereon.

It is a principal object of the present invention to provide improved means for explosively expanding portions of tubes positioned extending through passageways in a tube sheet so that the tubes will become intimately engaged with the tube sheet.

Another object is to provide improved means for closing the end of a plastic expansion tube in which an explosive charge is positioned.

Another object is to provide means for accurately locating an explosive detonator cord in an expandible tube.

Another object is to prevent movement of an explosive charge after it is positioned in a tubular expansion member. Another object is to teach the construction of an improved end cap for installing on expandible tubular members.

Another object is to provide accurate means for positioning an expandible tube in a tube to be expanded thereby.

Another object is to reduce the time and labor required to install explosive expansion devices in tubes to be expanded thereby.

Another object is to minimize the possibility of damaging a tube during explosive expansion thereof into intimate contact with a member through which it extends.

Another object is to provide improved means for attaching an end cap to a plastic tube member so as to minimize the possibility for relative movement therebetween.

Another object is to minimize the chance for damage to a tube and to any weldments or other means associated therewith when explosively expanding the tube outwardly into engagement with a surrounding surface.

These and other objects and advantages of the present invention will become apparent after considering the following detailed specification and the accompanying drawings, wherein:

FIG. 12 is a fragmentary cross-sectional view through another modified form of the subject device; and, FIG. 13 is a cross-sectional view taken on line 13—13 of FIG. 9.

Figures 1, 2, 3, 5, 6, 7, 8, 9, 10, 11:
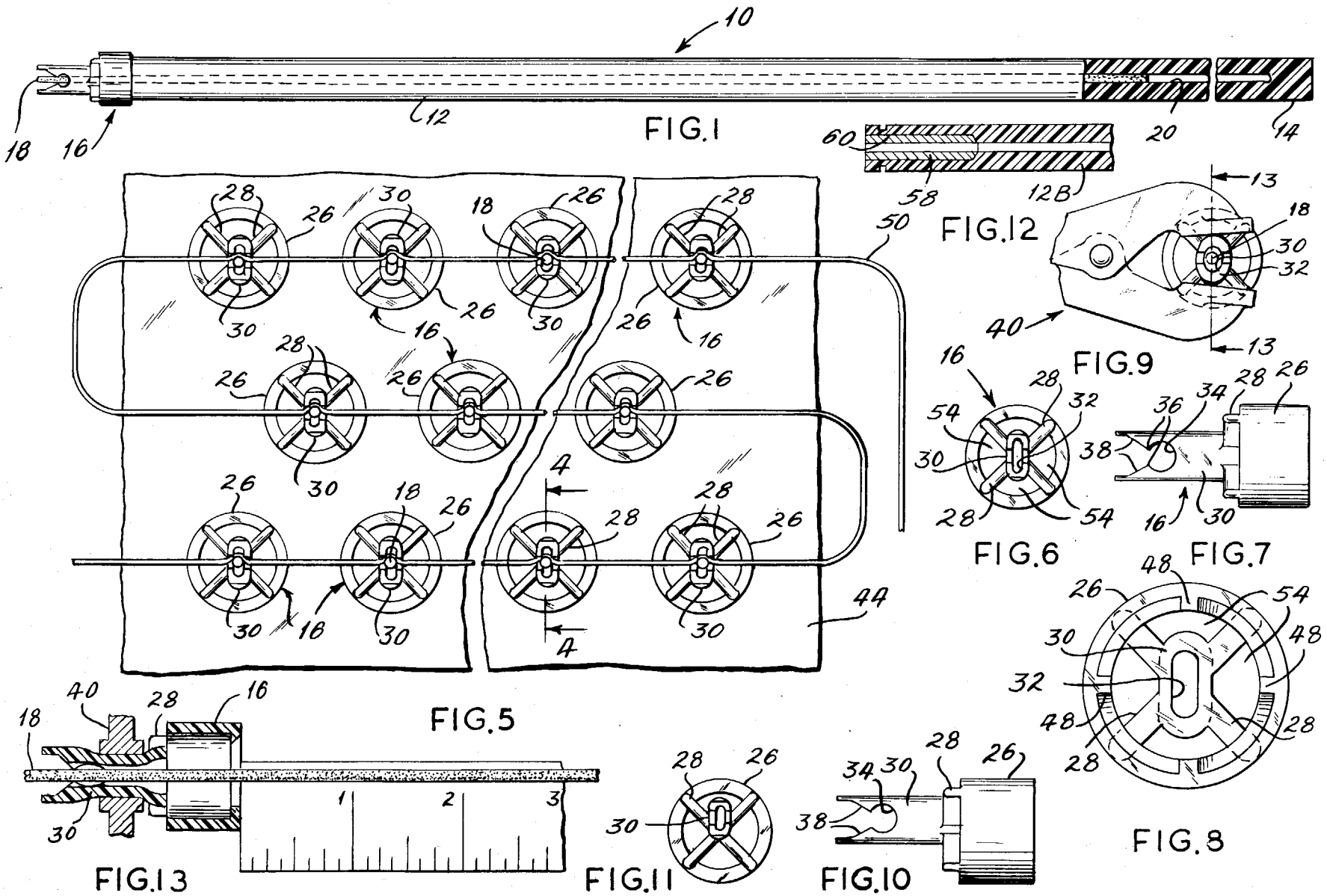
FIG. 1 is a side elevational view partly in cross-section of an expansion device constructed according to the present invention.
FIG. 2 is an enlarged, fragmentary, exploded, cross-sectional view, taken through the center, of the open end portion of a modified form of the subject expansion device.
FIG. 3 is a fragmentary, cross-sectional view, taken through the center, of the end portion of the modified form of the subject expansion device of FIG. 2, said view showing the cap member and tubular member of the subject device cooperating and the device being deformed to receive an explosive charge.
FIG. 5 is a fragmentary view of a tube sheet having a plurality of the subject expansion devices constructed according to the present invention installed therein and connected for simultaneous detonation.
FIG. 6 is an end view of the cap portion of the subject device.
FIG. 7 is a side view of the cap shown in FIG. 6.
FIG. 8 is an enlarged view of the right end of the cap shown in FIG. 7.
FIG. 9 is a view similar to FIG. 6 but showing a portion of the cap being deformed to receive an explosive member.
FIG. 10 is a side elevational view similar to FIG. 7 of a modified cap construction.
FIG. 11 is a left end view of the modified cap shown in FIG. 10.

Referring to the drawings more particularly by reference numbers, number 10 refers generally to an explosive expansion device constructed according to a preferred form of the present invention. The device 10 is shown as having an elongated plastic tubular member 12 which is closed at one end at 14. The opposite end of the tubular member 12 is open, and the open end receives an end cap 16 and a length of explosive cord 18, such as a length of Primacord, which is held in position in the end cap 16. The explosive cord 18 extends through the end cap which will be described later. When the device is assembled for use the cord 18 extends into a counterbore 20 formed in the tubular member 12 as clearly shown in FIG. 1.

The tubular member 12 is preferably constructed of a plastic or plastic material that is capable of being expanded outwardly with substantial force when the explosive cord 18 is detonated. However, when this happens the tubular member 12 should not rupture, fracture or otherwise be damaged so that the explosive materials could escape and contaminate the member being expanded. In other words, when the charge is set off it causes the tube 12 to expand outwardly into engagement with a member, to be described later, in which it is positioned, so as to cause said member to also expand outwardly and to be enlarged in diameter while at the same time becoming intimately engaged with the surface of a member or sheet in which it is positioned. A material that is particularly suitable for use in the construction of the tubular member 12 is polyethylene, although other plastic substances having similar but different resilient elastic characteristics can also be used. It is also helpful, if after having served its purpose, the tube 12 returns to its original size and diameter so as to facilitate its removal. The same is not true with respect to the tubular member being enlarged, which member is usually a metallic member, and which member when enlarged in diameter should not go back to its original size.

The tube 12 has an annular outside groove 22 formed near its open end. The groove 22 is shown as being square or rectangular in cross-section, and the groove cooperates with an annular inwardly extending flange 24 formed on the inside surface of an annular wall portion 26 of the end cap 16. The flange 24 is shown in FIGS. 2–4 as being tapered in cross-section to facilitate its installation by sliding it onto the end of the tube 12 and yet the shape of the flange 24 makes it difficult to remove the end cap 16 by pulling it off the tube once it is installed.

Figures 2, 3, 4:
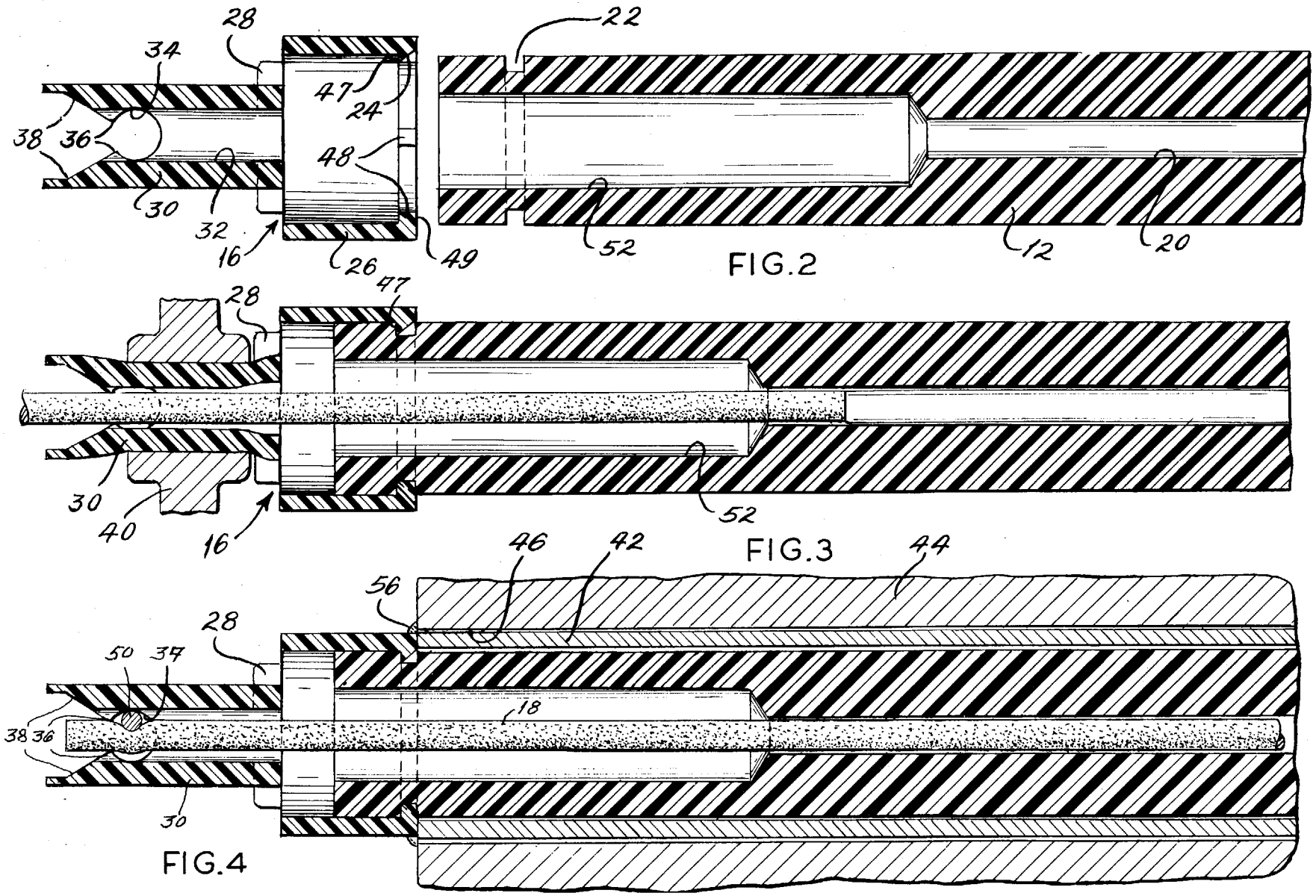
FIG. 4 is an enlarged fragmentary cross-sectional view taken on line 4—4 of FIG. 5.

Referring to FIGS. 6–8 the end cap 16 is shown having four radially extending portions or spokes 28 with the outer ends of the spokes connected to the cap wall portion 26 at the opposite end from the flange 24. The inner ends of the spokes 28 are integrally connected to one end of a smaller diameter oval or non-round shaped tubular portion 30. The oval or non-round portion 30 has a correspondingly shaped passage 32 that extends therethrough. The end of the tubular portion 30 opposite from the end that is connected to the spokes 28 has a transverse bore or slot 34 therethrough and the bore 34 intersects with one end of the passage 32. The size and shape of the bore 34 is such as to form two inwardly extending projections 36, the purposes for which will become apparent later. The free end of the tubular portion 30 is formed by two similar but oppositely tapered end surfaces 38. The end cap, like the tube 12, is preferably constructed of a resilient plastic substance such as polyethylene.

The passage 32 in the oval tubular portion 30 is selected to have a cross-sectional size and shape such that the explosive cord 18 cannot pass through the passage 32 when the portion 30 is in its unstressed condition as shown in FIGS. 6–8. However, if pressure is applied to opposite sides of the tubular portion 30 in the direction as shown in FIGS. 3, 9, and 13, the portion 30 will be deformed from its oval or non-round condition to a round or near round condition. In this condition the cord can easily be passed through the portion 30 by sliding it through from one end. The clamping force required to make the portion 30 round is not great and can be applied easily and quickly to opposite sides of the tubular portion 30 using a relatively simple clamping device such as the device 40 (FIGS. 3, 9, and 13) or a simple hand tool such as a pair of pliers or the like. When the cord 18 is properly positioned in the passage 32, the clamping force is removed so that the portion 30 will return to its oval shape and in so doing will engage and clamp the cord and prevent its further movement in the cap 16. This means that the free end of the detonator cord which extends from the tubular portion 30 on the side thereof that is to be attached to the tube 12, which is also the portion of the cord that is to be positioned in the passage 20, can easily be given any desired length. In the usual case this length will be set so that the cord 18 will only extend in the passage 20 in the tube 12 a distance equal to the distance that tube 42 to be expanded extends through sheet 44 to which it is to be attached. The end portions of each of the tubes 42, of which there are usually two for each tube, are positioned in passages 46 in the tube sheet 44 as clearly shown in FIG. 4. In a typical installation such as in an atomic reactor the tubes to be expanded are U-shaped tubes which have each of their opposite end portions positioned in spaced passages 46 in the sheet 44. The cord 18 usually properly located in the tubular portion 30 of the cap 16 before the clamping pressure is released and thereafter when the clamping device 40 is released the portion 30 will clamp and hold the cord against further movement. As explained, the length of the cord that extends from the cap 16 accurately determines the position the cord 18 will have when it is inserted into the tube 12 with the cap installed thereon and it also determines the position the cord will have in the tube 42 when the device 10 is installed therein.

It is important to note that the cap 16 has a larger outside diameter than the tube 12 so that when the tube 12 is inserted into the tubular member 42 to be expanded, the cap 16 will move into and abut the end of the member 42 and/or the sheet 44 to prevent further movement and to control the amount that the explosive cord extends into the tube 42. In most cases, the end of the explosive cord 18 should extend just to the opposite side of the sheet 44 from the side where the tube 12 is inserted and no further. This is so that when the cord is exploded little or no expansion force will be produced to expand the portion of the tube 42 that extends beyond the sheet 44 which otherwise might bulge and break or be damaged or rupture. However, the plastic tube 12 when positioned to be detonated will extend in the tube 42 substantially beyond the sheet 44, and the portion of the tube 12 which extends beyond the sheet 44 is empty of explosive and forms a closed ended expansion chamber that will absorb and dissipate some of the explosive force over a relatively large area of the tube 12 without damage to the tube 42 and without rupturing it. The fact that the end of the plastic tube 12 is closed at 14 is important to prevent the products of the explosion from escaping into and undesirably contaminating the tube 42.

During assembly when the explosive cord 18 is positioned in the end cap 16 as described, it is installed in the tubular member 12 by placing the free end in the open end of the bore 20 and sliding it, while attached to the end cap 16, into the tube 12 until the end cap prevents further movement. The end cap is then forced onto the free end of the tube 12 until the annular flange 24 snaps into position in the groove 22. The beveled shape of the annular flange 24 makes it relatively easy to slide it onto the tube 12. The radial shape of the trailing edge surface 47 of the flange 24 makes it difficult for the end cap to be taken off once it is installed. The annular beveled surface of the annular flange 24 preferably also has a plurality of spaced generally triangular or nearly triangular shaped projections 48 formed thereon. The projections 48 have radial side edge surfaces 49 that are provided to engage the opposite side wall of the groove 22 when the cap 16 is installed to prevent the flange 24 from easily being moved completely over and past the groove 22 during installation. This is because the surfaces 49 of the projections 48 will engage the groove 22 as it is being installed making it very difficult to force the end cap to move too far on the tube 12 when being installed. This is important to the proper location of the end cap 16 on the tube 12 and serves as a means to control the amount of the cord 18 that extends into the tube 12. Accurate placement of the cap on the tube 12 also controls where the explosive cord will end when the tube 12 is inserted in the tube 42.

In the usual situation a plurality of devices such as the device 10 are installed simultaneously in a plurality of the tubes 42 each positioned in a different passage such as the passage 46 in the sheet 44 as shown in FIGS. 4 and 5. After a plurality of devices are installed, a detonator cord 50 is attached to each of the devices to be detonated so that all of the attached devices can be detonated simultaneously. The detonator cord 50 is attached to the device by placing it against one of the beveled end edge surfaces 38 of the oval tubular portions 30 along one side of the explosive cord 18. The cord 50 is then pressed to force it past the projections 36 so that it snaps into position in the associated crossbore 34. In this way good frictional engagement is made between the detonator cord 50 and the explosive cord 18 in each of the devices to be exploded. Any number of devices can be connected for detonation by the same detonator cord 50, and the opposite ends of the cord 50 are connected to a suitable source of detonator energy, not shown.

In the preferred form of the present device the tubular end cap portion 30 is centered axially with the portion 26 so that the explosive cord 18 remains on or near to the axes of the devices 10. It is anticipated, however, that in some cases it may be preferred to have the portion 30 located off the axes of the caps 16 and off the axes of the tubes 12 as shown in FIGS. 10 and 11. In the off axis construction some portion of the explosive cord 18 will be bent to some extent but this is usually not objectionable and may be advantageous especially when the passages in the tubes 12 are enlarged at their open ends as at 52 in FIGS. 2, 3 and 4. The enlarged passage portions 52 when used are located extending from the free ends of the tubes 12 and combine with openings 54 which optionally may be provided in the cap 16 as shown, and are formed by and between the spokes 28 in the cap 16, to enable the forces produced near the ends of the tubes during explosion to relatively easily escape without producing substantial outward pressure against the tubes 12 and 42 in the region of the passage enlargements 52. The cap may also be closed by an integral wall or diaphragm extending between the portions 26 and 30. The closed construction is suitable for some applications. The passage enlargements 52 and the openings 54 are usually desirable especially when the metal tubes 42 to be expanded are welded adjacent to their open ends to the sheet 44 as at 56 (FIG. 4). Reducing the expansion forces at and near the open ends of the tubes 42 therefore minimizes the possibility for damaging or rupturing the tubes 42 and for weakening the welds 56 at the location where the tubes are most vulnerable which is at or near their open ends.

FIG. 12 shows another modified form of the subject construction wherein a tubular sleeve 58, such as an aluminum sleeve, is positioned in an enlarged end chamber portion 60 of the tube 12B. The sleeve 58 is of a harder and less resilient material than the tube 12B in which it is positioned and its presence serves to reduce the outward forces that otherwise would be available to expand the tube 42 near its open end.

As stated, the tubes 42 are usually metal tubes made of a metal or metal alloy such as inconel although other metals can also be used as well. The sheets 44 may be steel or stainless steel sheets. Other materials and uses for the subject devices are also possible, and it is not intended to limit the invention to those mentioned herein.

Thus there has been shown and described novel tube expansion means which fulfill all of the objects and advantages sought therefor. It will be apparent to those skilled in the art, however, that many changes, modifications, variations and other uses and applications of the subject means are possible. All such changes, modifications, variations and other uses and applications which do not depart from the spirit and scope of the invention are deemed to be covered by the invention which is limited only by the claims which follow.

What is claimed is:

1. Means for explosively expanding outwardly a portion of a tubular member positioned extending through a passage in a wall member so that the tubular member moves into intimate contact with the passage in the wall member, comprising a plastic tubular member having an outside diameter approximately the same as the inside diameter of the tubular member to be expanded, said plastic tubular member having an outside surface, a counter bore extending into the plastic tubular member from one end thereof, a groove formed in the outside surface of the plastic tubular member adjacent to the said one end thereof, a cap for attaching to the one end of the plastic tubular member, said cap having an annular wall portion with an inside diameter approximately the same as the outside diameter of the plastic tubular member, means on said annular cap wall engageable with the groove when the cap is installed, and a smaller diameter tubular cap portion including means connecting said smaller diameter tubular portion to the annular cap wall.

2. The means defined in claim 1 including means forming an opening in the means on the end cap that connect the smaller diameter tubular portion to the annular cap wall.

3. The means defined in claim 1 wherein the smaller diameter tubular cap portion has a non-round shaped passage extending therethrough.

4. The means defined in claim 1 wherein the smaller diameter tubular cap portion has an oval shaped cross-section.

5. The means defined in claim 1 wherein the plastic tubular member is constructed of polyethylene.

6. The means defined in claim 1 including a plurality of spaced members connecting the smaller diameter tubular cap portion to the annular cap wall.

7. The means defined in claim 1 wherein the smaller diameter tubular cap portion is aligned axially with the annular wall portion of said cap.

8. The means defined in claim 1 wherein the smaller diameter tubular cap portion has an axis spaced laterally from the axis of the annular wall portion of said cap.

9. The means defined in claim 4 including an elongated explosive cord member, said cord member having an outside diameter that is greater than the smaller diameter of the oval shaped passage through the smaller diameter tubular cap potion and smaller than the larger diameter axis thereof.

10. The means defined in claim 9 including means forming a cross bore through the smaller diameter tubular portion adjacent to the free end thereof intersecting the passage therethrough, said cross bore having that is larger than the diameter of the explosive cord to define a space adjacent at least one side of a cord positioned extending through the passage in the smaller diameter tubular portion.

11. Means for explosively expanding a metal tubular member positioned extending through a passage in a wall member to enlarge its diameter whereby said tubular member becomes intimately engaged with the passage in the wall member, comprising a wall member having a passage therethrough, a tubular member having a portion thereof extending through the passage in the wall member, an elongated plastic tubular member having an outside diameter approximately the same as the inside diameter of the metallic tubular member to be expanded, a bore extending into the plastic tubular member from one end thereof, a cap for attaching to the one end of the plastic tubular member, said cap having a larger diameter portion with an inside diameter that is approximately the same diameter as the outside diameter of the plastic tubular member, cooperating means on the cap and on the plastic tubular member to limit movement of the cap onto the plastic tubular member and to limit movement of the plastic tubular member into the metallic tubular member to be expanded, a smaller diameter tubular cap portion having an axis that is parallel to the axis of the plastic tubular member, and means on the cap integrally connecting the larger and smaller diameter cap portions.

12. The means defined in claim 11 wherein the smaller diameter tubular cap portion has a non-round cross-sectional shape.

13. The means defined in claim 11 including an explosive cord, said explosive cord having a diameter such that it can be positioned extending into the bore in the plastic tubular member and through the smaller diameter tubular cap portion.

14. The means defined in claim 11 including passage means formed in the cap between the larger and smaller diameter cap portions.

15. The means defined in claim 11 wherein the smaller diameter tubular cap portion is aligned axially with the plastic tubular member when the cap is installed thereon.

16. The means defined in claim 11 wherein the smaller diameter tubular cap portion has an oval shaped cross-section.

17. The means defined in claim 11 wherein the smaller diameter tubular cap portion has a cross bore formed near the free end thereof, and an end surface on said smaller diameter cap portion angularly related to the axis thereof and extending from the cross bore to the end thereof.

18. The means defined in claim 11 wherein the plastic tubular member has an annular outside groove formed therein at a location spaced from the one end thereof, said end cap having an annular wall with an inwardly extending flange for cooperating with the annular groove to hold the end cap in place thereon.

19. The means defined in claim 11 wherein the plastic tubular member and the end cap are formed of polyethylene.

20. The means defined in claim 11 wherein the plastic tubular member has an enlarged chamber portion extending inwardly from the end thereof.

21. The means defined in claim 20 including a metal sleeve positioned in the enlarged chamber portion.

* * * * *

UNITED STATES PATENT OFFICE

CERTIFICATE OF CORRECTION

Patent No. 3,993,001 Dated November 23, 1976

Inventor(s) Frederick L. Hawes

It is certified that error appears in the above-identified patent and that said Letters Patent are hereby corrected as shown below:

Column 1, line 66, after the period (.), a new paragraph should begin with the word "Another".

Column 4, line 27, after "18" insert "is".

Column 7, line 21, after "ing" insert "a diameter".

Signed and Sealed this

Twenty-second Day of February 1977

[SEAL]

*Attest:*

RUTH C. MASON
*Attesting Officer*

C. MARSHALL DANN
*Commissioner of Patents and Trademarks*